US006369683B1

(12) United States Patent
Iida et al.

(10) Patent No.: US 6,369,683 B1
(45) **Date of Patent: *Apr. 9, 2002**

(54) VARIABLE INDUCTOR

(75) Inventors: Naoki Iida, Sabae; Masahiko Kawaguchi, Takefu; Kazuyoshi Uchiyama, Fukui-ken, all of (JP)

(73) Assignee: Murata Manufacturing Co., LTD, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/495,498

(22) Filed: Feb. 1, 2000

(30) Foreign Application Priority Data

Feb. 4, 1999 (JP) ..... 11-026876

(51) Int. Cl.[7] ..... H01F 5/00

(52) U.S. Cl. ..... 336/200; 336/83; 336/232; 257/531

(58) Field of Search ..... 336/83, 225, 200, 336/223, 232; 257/531

(56) References Cited

U.S. PATENT DOCUMENTS

| | | | | |
|---|---|---|---|---|
| 3,858,138 A | * | 12/1974 | Gittleman et al. | 336/136 |
| 4,035,695 A | * | 7/1977 | Knutson et al. | 361/400 |
| 4,942,373 A | * | 7/1990 | Ozawa et al. | 333/161 |
| 6,005,467 A | * | 12/1999 | Abramov | 336/200 |

FOREIGN PATENT DOCUMENTS

| | | | |
|---|---|---|---|
| JP | 55-91850 | * | 7/1980 |

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A variable inductor includes two substantially meandering coils with trimming electrodes disposed therebetween on an insulating substrate. The trimming electrodes are located outside the region where the coils are provided. The two coils and the trimming electrodes are electrically connected. The trimming electrodes are exposed to a laser beam and thus, are trimmed one by one so as to vary the inductance.

13 Claims, 3 Drawing Sheets

VARIABLE INDUCTOR

BACKGROUND OF THE INVENTION

1. Field of the Invention

The present invention generally relates to variable inductors, and more particularly, the present invention relates to variable inductors for use in mobile communications equipment.

2. Description of the Related Art

In electronic equipment, and in particular, in mobile communications equipment such as cellular telephones and car telephones, which are required to be miniaturized, miniaturization of internal components is also necessary. The higher the operating frequency, the more complex the circuitry must be. Also, there must be minimal variation among components. Referring to FIG. 5, a circuit including a center tap electrode pattern connected to the electrical center point of two coils may be obtained by mounting two coils 21 and 22 on a printed circuit board 26 and then electrically connecting the two coils 21 and 22 via circuit patterns 23 and 24 and a center tap electrode pattern 25 on the printed board 26. The inductance values of the coils 21 and 22 are varied by detaching the coils 21 and 22 and replacing them with two different coils which have different inductance values and which are balanced in advance. Alternatively, variable inductance coils are used for the coils 21 and 22 to vary and balance the inductance values of the two coils 21 and 22.

The above methods fail to balance the inductance values of the coils 21 and 22 due to variations in the inductance values of the coils 21 and 22 and positional deviations of the coils 21 and 22 when they are mounted. This causes the center tap electrode pattern 25 to be connected at a location that is spaced away from the electrical center point of the coil defined by the coils 21 and 22. The coils 21 and 22 are electrically connected through the center tap electrode pattern 25 disposed on the printed board 26, which configuration occupies substantial space on the printed circuit board 26.

The method of replacing the coils 21 and 22 with two different coils to vary the inductance values involves the burdensome and difficult work of dismounting the coils 21 and 22, and hence it is difficult to automate this process. Also, the method of using the variable coils for the coils 21 and 22 involves the burdensome and difficult work of balancing and adjusting the inductance values of the coils 21 and 22, and hence it is difficult to automate this process. The lower the desired inductance value, the more powerful the influence of inductance components of the patterns 23 to 25. Therefore, it is difficult to obtain a minimal inductance value easily and economically, while also obtaining a miniaturized component.

SUMMARY OF THE INVENTION

In order to overcome the problems described above, preferred embodiments of the present invention provide a variable inductor including at least two coils which occupy minimal space on a printed circuit board and having inductance values which are easily adjusted to be reliably and uniformly balanced.

According to one preferred embodiment of the present invention, a variable inductor includes an insulating substrate, at least two substantially meandering coils provided on the insulating substrate, a trimming electrode arranged to adjust an inductance value, which is disposed on the insulating substrate outside of the region where the two coils are located and which electrically connects the two coils, two input/output external electrodes electrically connected to one end of each of the two coils, and an intermediate tap electrode electrically connected to another end of each of the two coils.

The trimming electrode is trimmed to vary the inductance value between the input/output external electrodes of each coil, or the inductance value between the input/output electrode and the intermediate tap electrode, without disrupting the balance between the inductance values of the two coils. The trimming electrode is disposed outside of the region where the substantially meandering coils are located, thereby reducing the degree of interruption in which the trimming electrode interrupts a magnetic field generated by the meandering coils. Therefore, an inductor having a greatly increased, very high Q-value is achieved.

The distance between adjoining portions of the coils may be set to be at least about twice the line width of the coils, so that the distance between the magnetic fields generated in the adjoining portions is increased, and magnetic field interference is thereby minimized.

Other elements, features, characteristics and advantages of the present invention will become apparent from the following description of preferred embodiments of the invention which refers to the accompanying drawings.

DETAILED DESCRIPTION OF PREFERRED EMBODIMENTS

Figure 1:
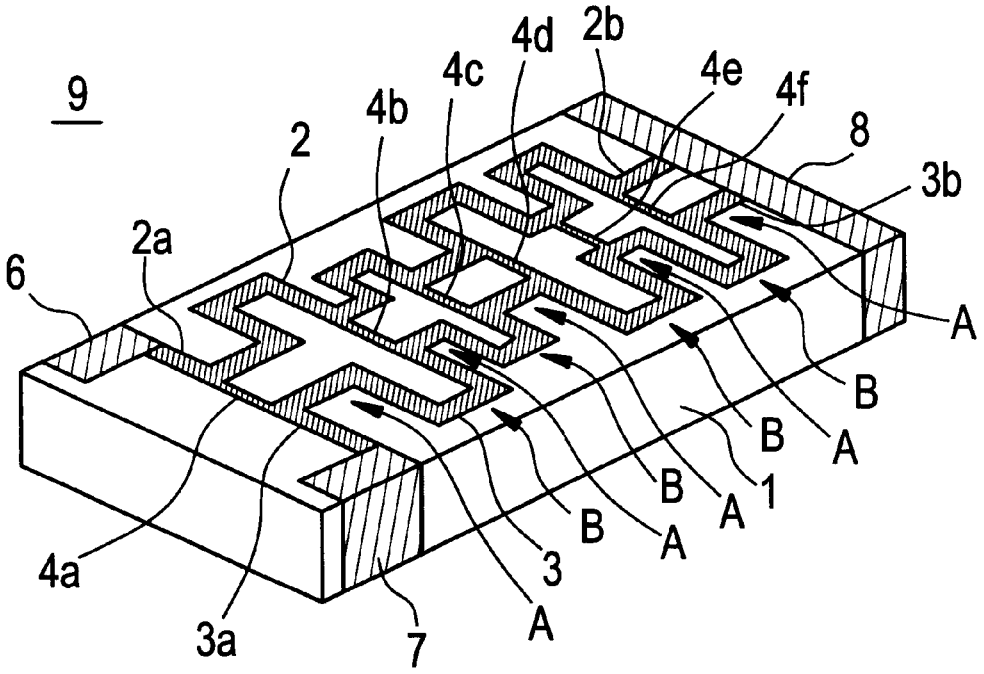
FIG. 1 is a perspective view of a variable inductor according to a first preferred embodiment of the present invention.

Referring to FIG. 1, a variable inductor according to a first preferred embodiment of the present invention is described. An insulating substrate 1 is preferably polished so that the top surface thereof becomes smooth. Substantially meandering coils 2 and 3 and trimming electrodes 4*a* to 4*f* are provided on the top surface of the insulating substrate 1. The coils 2, 3 and trimming electrodes 4*a*–4*f* are preferably formed via a thick-film screen printing process or a thin-film forming process, e.g., photolithography.

In the thick-film screen printing process, a masking material having apertures with desired patterns and shapes is laid over the top surface of the insulating substrate 1. An electrically conductive paste is applied on the masking material, thus forming relatively thick-film conductive materials (for example, in the first preferred embodiment, the coils 2 and 3 and the trimming electrodes 4*a* to 4*f*) having desired patterns and shapes on the top surface of the insulating substrate 1 exposed from the apertures of the masking material.

In the photolithography process, a relatively thin-film electrically conductive film is formed substantially over the entire top surface of the insulating substrate 1. A resist film (for example, a photosensitive resin film) is formed substantially over the entirety of the conductive film by spin coating or printing. A mask film with a predetermined image pattern is laid over the top surface of the resist film. A desired portion of the resist film is cured by, for example, exposure to ultraviolet ray. The resist film is then stripped off, leaving the cured portion. The exposed conductive film is removed, and conductive pattern having desired patterns and shapes are thereby formed. Subsequently, the cured resist film is removed.

Another example of the photolithography process is performed by applying a photosensitive conductive paste on the top surface of the insulating substrate 1 and covering it with a mask film having a predetermined image pattern. The substrate 1 is then exposed and developed.

The coils 2 and 3 are arranged preferably to have bilateral symmetry on the insulating substrate 1. The inductance values of the coils 2 and 3 are substantially equal. An end 2*a* of the coil 2 leads to the back of the left end of the insulating substrate 1, and another end 2*b* of the coil 2 leads to the back of the right end of the insulating substrate 1. An end 3*a* of the coil 3 leads to the front of the left end of the insulating substrate 1, and another end 3*b* of the coil 3 leads to the front of the right end of the insulating substrate 1.

The trimming electrodes 4*a* to 4*f* extends across the two coils 2 and 3 in a ladder-like arrangement, and are disposed substantially in the approximate center of the insulating substrate 1. The trimming electrodes 4*a* to 4*f* are disposed outside the region where the coils 2 and 3 are located. More specifically, the trimming electrodes 4*a* to 4*b* are disposed in an area (indicated by the letter A in FIG. 1) where the two meandering coils 2 and 3 are close to each other, and not in an area (indicated by the letter B in FIG. 1) where the two meandering coils 2 and 3 are far apart. Preferably, the line width of the trimming electrodes 4*a* to 4*f* is set to be less than the line width of the coils 2 and 3. For example, when the line width of the coils 2 and 3 is about 100 $\mu$m, the line width of the trimming electrodes 4*a* to 4*f* is about 50 $\mu$m.

The insulating substrate 1 may be made of glass, glass-ceramic, alumina, ferrite or other suitable material. The coils 2 and 3 and the trimming electrodes 4*a* to 4*f* may be made of Ag, Ag—Pd, Cu, Au, Ni, Al or other suitable material.

If desired, a liquid insulating material may be applied over the entire top surface of the insulating substrate 1 via spin coating or printing. The liquid insulating material is then dried, and an insulating protection film covering the coils 2 and 3 and the trimming electrodes 4*a* to 4*f* is formed.

Figure 2:
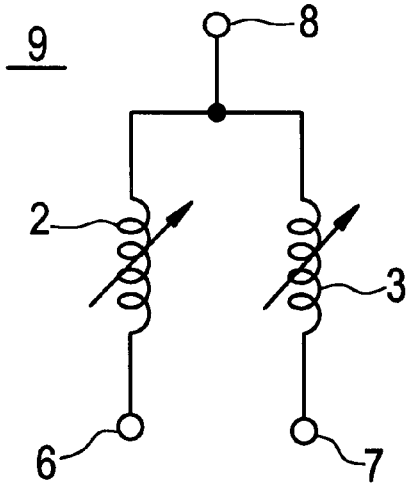
FIG. 2 is an electrical equivalent circuit diagram of the variable inductor shown in FIG. 1.

Next, input/output external electrodes 6 and 7 are disposed at the left end of the insulating substrate 1 in the longitudinal direction, and a center tap electrode 8 is provided at the right end. The input/output external electrode 6 is electrically connected to the end 2*a* of the coil 2. The input/output external electrode 7 is electrically connected to the end 3*a* of the coil 3. The center tap electrode 8 is electrically connected to other ends 2*b* and 3*b* of the coils 2 and 3. These electrodes 6 to 8 are formed preferably by applying an electrically conductive paste, e.g., Ag, Ag—Pd, Cu, Ni, NiCr, or NiCu or other suitable material, and then baking, dry plating, wet plating, or a combination of these methods. FIG. 2 is an electrical equivalent circuit diagram of a variable inductor 9.

Accordingly, the variable inductor 9 includes, on the insulating substrate 1, a circuit in which the two coils 2 and 3 are electrically connected through the center tap electrode 8. The trimming electrodes 4*a* to 4*f* are disposed outside of the region where the coils 2 and 3 are located, thereby reducing the degree of interruption in which the trimming electrodes 4*a* to 4*f* interrupt magnetic fields generated by the substantially meandering coils 2 and 3. Thus, the variable inductor 9 having a very high Q-value is achieved.

Figure 3:
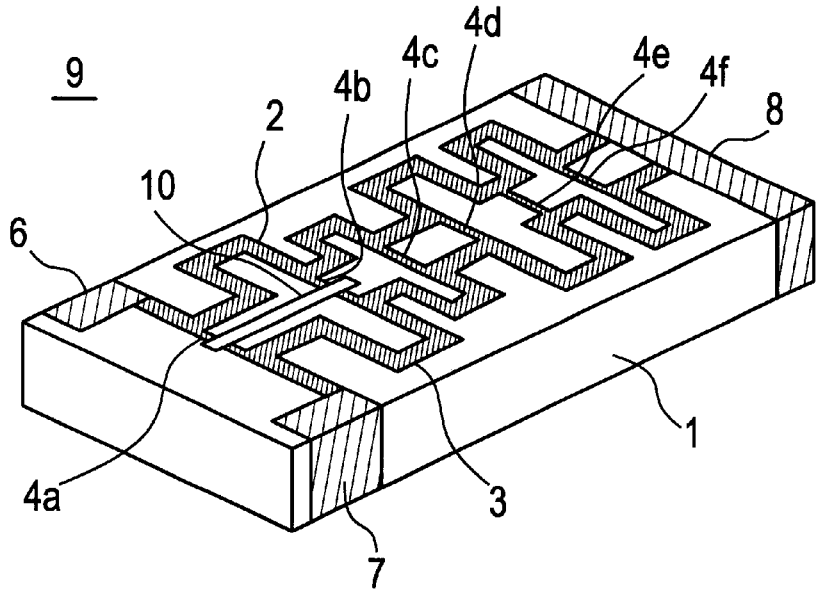
FIG. 3 is a perspective view of the variable inductor shown in FIG. 1 for illustrating an inductance trimming process.

The variable inductor 9 is mounted on a printed board or other substrate, and the trimming electrodes 4*a* to 4*f* are then trimmed. More specifically, the upper surface of the variable inductor 9 is exposed to a pulsed laser beam, so that a groove 10 is formed in the variable inductor 9, and the trimming electrodes 4*a* to 4*f* are trimmed one by one from the outside, as illustrated in FIG. 3. (FIG. 3 illustrates a condition where the trimming electrodes 4*a* and 4*b* are trimmed.) Accordingly, the inductance value between the input/output external electrodes 6 and 7 is varied in a stepwise manner, without varying the inductance value between the input/output external electrode 6 and the center tap electrode 8, and the inductance value between the input/output external electrode 7 and the center tap electrode 8. An electric current or a voltage may be applied to the center tap electrode 8.

The trimming electrodes 4*a* to 4*f* may be arranged on the printed circuit board or substrate in advance so that the inductance value between the input/output external electrodes 6 and 7 is varied in a desired pitch. Accordingly, the variable inductor 9 is obtained in which the inductance value between the input/output electrodes 6 and 7 is trimmed in a stepwise manner, while maintaining the balance between the inductance value between the input/output external electrode 6 and the center tap electrode 8, and the inductance value between the input/output external electrode 7 and the center tap electrode 8.

The variable inductor 9 preferably includes the two built-in coils 2 and 3. It is not necessary to electrically connect the two coils by circuit patterns disposed on a printed board, thus minimizing the space occupied. For example, the variable inductor 9 of the first preferred embodiment preferably has a length of about 3.2 mm and a width of about 1.6 mm. There is no influence of inductance components contained in the circuit patterns which are disposed on the printed board, permitting precise and very small adjustment of inductance values of the coils 2 and 3.

The coils 2 and 3 and the trimming electrodes 4*a* to 4*f* are preferably formed integrally on the insulating substrate 1 at the same time, so that the variable inductor 9 can be manufactured at low cost. There is no interlayer connection with via holes and through holes, so that high connection reliability is obtained.

The trimming electrodes 4*a* to 4*f* may be trimmed by processes other than the laser beam, such as by a sand blasting process. The groove 10 is not necessarily formed. As long as the trimming electrodes 4*a* to 4*f* are electrically disconnected, the groove 10 is not required to physically exist.

Figure 4:
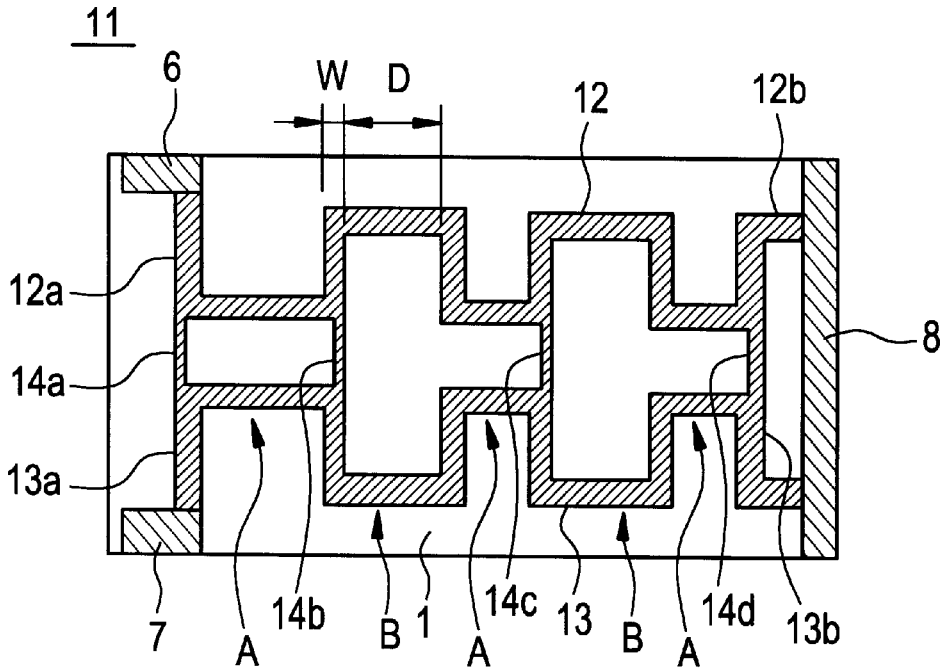
FIG. 4 is a plan view of a variable inductor according to a second preferred embodiment of the present invention.
Figure 5:
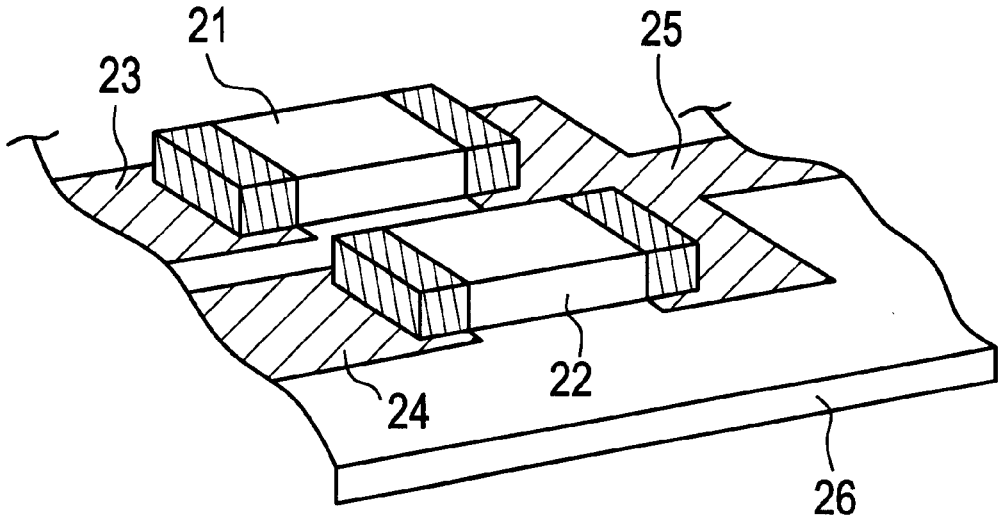
FIG. 5 PRIOR ART
FIG. 5 is a perspective view of a conventional variable inductor.

Referring now to FIG. 4, a variable inductor according to a second preferred embodiment is described. A variable inductor 11 includes substantially meandering coils 12 and 13 and trimming electrodes 14*a* to 14*d* disposed on the top surface of an insulating substrate 1. The substantially meandering coil 12 is arranged such that the distance D between adjoining portions of the coil is at least about twice the line width W thereof. Similarly, the substantially meandering coil 13 is formed such that the distance D between adjoining portions is at least about twice the line width W.

The trimming electrodes 14*a* to 14*d* bridge the two coils 12 and 13 in a ladder-like arrangement, and are disposed in the approximate center of the insulating substrate 1. The trimming electrodes 14*a* to 14*d* are disposed outside the region where the coils 12 and 13 are located. More specifically, the trimming electrodes 14*a* to 14*d* are disposed in an area (indicated by the letter A in FIG. 4) where the two meandering coils 12 and 13 are close to each other, and not in an area (indicated by the letter B in FIG. 4) where the two meandering coils 12 and 13 are far apart.

Whereas the trimming electrode 4*e* of the first preferred embodiment is disposed in the approximate center of the area (indicated by the letter A in FIG. 1) where the two coils 2 and 3 are close to each other, all the trimming electrodes 14*a* to 14*d* are disposed at the end of the area (indicated by the letter A in FIG. 4) where the two coils 12 and 13 are close to each other. In the second preferred embodiment, further efforts have been made to reduce the degree of interruption of magnetic fields generated by the coils 12 and 13 with the trimming electrodes 14*a* to 14*d*.

The meandering coils 12 and 13 are arranged to have bilateral symmetry on the insulating substrate 1. The coil 12 is electrically connected at an end 12*a* to an input/output external electrode 6. The coil 13 is electrically connected at an end 13*a* to an input/output external electrode 7. Other ends 12*b* and 13*b* of the coils 12 and 13 are electrically connected to a center tap electrode 8.

Accordingly, the variable inductor 11 is as advantageous as the variable inductor 9 of the first preferred embodiment. Furthermore, the distance between the adjoining portions of the coils 12 and 13 is preferably at least about twice the line width W. This increases the distance between the magnetic fields generated in the adjoining portions, and magnetic field interference is reduced. Therefore, a decrease in the Q-value of the inductor 11 is further prevented.

Although the present invention has been described with respect to the above preferred embodiments, it is to be understood that modifications will be apparent to those skilled in the art without departing from the spirit of the invention.

The preferred embodiments illustrate a case where variable inductors are produced one by one. For mass production, it is effective to use a method of manufacturing a mother wafer provided with a plurality of variable inductors, and cutting the wafer for every product size by dicing, a scribe-and-break method, a laser, or other suitable method. The two coils may have any shape as long as the two coils have substantially meandering shapes. Alternatively, the coils may have sine curve shapes. The two coils do not necessarily have to be disposed in bilateral symmetry. The two coils may be of different shapes. The two coils may be set to have different inductance values. The variable inductor may include three or more coils. In such a case, the trimming electrodes are provided in between two adjacent coils, respectively.

What is claimed is:

1. A variable inductor comprising:

an insulating substrate;

at least two coils provided on a region of said insulating substrate;

at least one trimming electrode arranged to adjust an inductance value of the variable inductor, said at least one trimming electrode disposed on a different region of said insulating substrate from the region where the at least two coils are located, and said at least one trimming electrode extending between and electrically connecting the at least two coils;

two input/output external electrodes electrically connected to one end of each of the at least two coils; and an intermediate tap electrode electrically connected to the other end of each of the at least two coils.

2. A variable inductor according to claim 1, wherein the distance between adjacent portions of the at least two coils is at least twice the line width of the coils.

3. A variable inductor according to claim 1, wherein said at least two coils have a substantially meandering arrangement.

4. A variable inductor according to claim 1, wherein said at least two coils have substantially the same shape.

5. A variable inductor according to claim 1, wherein said at least two coils are arranged to be symmetrical about a longitudinal axis of the insulating substrate.

6. A variable inductor according to claim 1, wherein said at least two coils comprise thin film electrodes.

7. A variable inductor according to claim 1, wherein said at least two coils comprise thick film electrodes.

8. A variable inductor according to claim 1, wherein a groove is formed in the insulating substrate.

9. A variable inductor according to claim 1, wherein the at least one trimming electrode bridges the at least two coils in a ladder-like arrangement.

10. A variable inductor according to claim 1, wherein the at least one trimming electrode is disposed in the approximate center of the insulating substrate.

11. A variable inductor according to claim 1, wherein at least one of the at least two coils is arranged such that the distance D between adjacent portions of the coil is at least twice the line width W thereof.

12. A variable inductor according to claim 1, wherein each of the at least two coils is arranged such that the distance D between adjacent portions of the coil is at least twice the line width W thereof.

13. A variable inductor according to claim 1, wherein the distance between adjacent portions of the at least two coils is at least twice the line width W thereof.

* * * * *